US006568557B2

(12) United States Patent
Fusco et al.

(10) Patent No.: US 6,568,557 B2
(45) Date of Patent: May 27, 2003

(54) SPILL PROOF TRAINING CUP

(75) Inventors: Michael T. Fusco, Johnston, RI (US); William St. Pierre, Forestdale, MA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/803,844

(22) Filed: Mar. 12, 2001

(65) Prior Publication Data

US 2001/0035420 A1 Nov. 1, 2001

Related U.S. Application Data

(60) Provisional application No. 60/189,832, filed on Mar. 16, 2000.

(51) Int. Cl.[7] ..... A47G 19/22

(52) U.S. Cl. ..... 220/714; 215/11.5; 222/482

(58) Field of Search ..... 220/714; 215/11.4, 215/11.5, DIG. 7; 222/482

(56) References Cited

U.S. PATENT DOCUMENTS

| | | | |
|---|---|---|---|
| 1,797,280 | A | 3/1931 | Zerk |
| 2,107,442 | A | 2/1938 | Hughes |
| 2,223,944 | A | 12/1940 | Roy |
| 2,569,073 | A | 9/1951 | Robinson |
| 2,674,318 | A | 4/1954 | Sutliff |
| 2,876,772 | A | 3/1959 | Witz |
| 3,155,110 | A | 11/1964 | Hoffman |
| 3,159,176 | A | 12/1964 | Russell et al. |
| 3,228,418 | A | 1/1966 | Rosback et al. |
| 3,245,428 | A | 4/1966 | Klimak et al. |
| 3,504,699 | A | 4/1970 | Grise |
| 3,517,682 | A | 6/1970 | Smith |
| 3,626,978 | A | 12/1971 | Koekstra |
| 3,633,613 | A | 1/1972 | Julow |
| 3,635,380 | A | 1/1972 | Fitzgerald |
| 3,727,808 | A | 4/1973 | Fitzgerald |
| 3,807,445 | A | 4/1974 | McPhee |
| 3,822,720 | A | 7/1974 | Souza |
| 3,889,710 | A | 6/1975 | Brost |
| 3,915,331 | A | 10/1975 | Chenault |
| 3,954,121 | A | 5/1976 | Kardos |
| 3,967,748 | A | 7/1976 | Albert |
| 4,113,135 | A | 9/1978 | Yamazaki |
| 4,135,513 | A | 1/1979 | Arisland |
| 4,141,379 | A | 2/1979 | Manske |
| 4,181,145 | A | 1/1980 | Mitchell |

(List continued on next page.)

FOREIGN PATENT DOCUMENTS

| | | |
|---|---|---|
| EP | 0634922 B1 | 1/1995 |
| FR | 1 417 355 | 2/1966 |
| GB | 2169210 | 7/1986 |
| GB | 2 266 045 A | 10/1993 |
| GB | 2266045 | 9/1996 |
| GB | 2 314 497 A | 1/1998 |
| JP | 08034452 | 2/1996 |

*Primary Examiner*—Joseph M. Moy
(74) *Attorney, Agent, or Firm*—Barnes & Thornburg

(57) ABSTRACT

A no spill training cup includes a cup and cover with a drinking spout in the cover. The cover also has a vent opening for maintaining the ambient pressure in the cup with the vent opening being covered by a hydrophobic membrane that allows the flow of air into the cup but prevents liquid from flowing out of the cup through the vent opening. A valve housing is attached to the cover on the inlet side of the spout. The valve includes a diaphragm supported in the housing and biased to engage a valve seat in the housing to prevent flow of liquid from the cup to the spout. When a child sucks on the spout, the pressure on the outlet side of the diaphragm causes it to disengage the valve seat and allow the liquid to flow out of the cup through the spout. When the child stops sucking on the spout, the valve immediately returns to its closed position on the seat so as to prohibit the flow of liquid from the cup through the spout.

32 Claims, 3 Drawing Sheets

U.S. PATENT DOCUMENTS 4,190,174 A 2/1980 Haimowitz
4,190,426 A 2/1980 Ruschke
4,210,173 A 7/1980 Choksi et al.
4,222,407 A 9/1980 Ruschke et al.
4,238,207 A 12/1980 Ruschke
4,245,752 A 1/1981 Prueher
4,246,932 A 1/1981 Raines
4,286,628 A 9/1981 Paradis et al.
4,298,358 A 11/1981 Ruschke
4,310,017 A 1/1982 Raines
4,341,239 A 7/1982 Atkinson
4,369,812 A 1/1983 Paradis et al.
4,388,996 A 6/1983 Panicci
4,415,003 A 11/1983 Paradis et al.
4,461,313 A 7/1984 Beaumont
4,518,014 A 5/1985 McAlpine
4,535,820 A 8/1985 Raines
4,538,508 A 9/1985 Ballard
4,550,749 A 11/1985 Krikorian
4,610,275 A 9/1986 Beecher
4,712,704 A 12/1987 Ramsey et al.
4,749,003 A 6/1988 Leason
4,828,141 A 5/1989 Coy
4,836,404 A 6/1989 Coy
4,946,062 A 8/1990 Coy
5,050,758 A 9/1991 Freeman et al.
5,071,017 A 12/1991 Stull
5,079,013 A 1/1992 Belanger
5,150,815 A 9/1992 Saklad
5,169,016 A 12/1992 Hinz, Jr.
5,186,347 A 2/1993 Freeman et al.
5,273,172 A 12/1993 Rossbach et al.
5,295,597 A 3/1994 Green
5,339,982 A 8/1994 Tardie
5,339,995 A 8/1994 Brown et al.
5,465,866 A 11/1995 Belcastro
5,540,350 A 7/1996 Lansky
5,542,670 A 8/1996 Morano
5,570,796 A 11/1996 Brown et al.
5,607,073 A 3/1997 Forrer
5,706,973 A 1/1998 Robbins, III et al.
5,799,814 A 9/1998 Schaefer et al.
5,890,619 A 4/1999 Belanger
5,890,620 A * 4/1999 Belcastro ..... 220/714
5,890,621 A 4/1999 Bachman et al.
5,893,472 A 4/1999 Forrer

* cited by examiner

SPILL PROOF TRAINING CUP

This application claims the benefits of applicant's earlier filed, copending provisional application Ser. No. 60/189,832 filed Mar. 16, 2000.

FIELD OF THE INVENTION

This invention relates to training cups for toddlers and more particularly comprises a spill proof training cup.

BACKGROUND OF THE INVENTION

There are presently available a number of so called "no spill" training cups for toddlers. As the name implies, these cups are intended to prevent liquid spilling from the cups when they are inverted or dropped. Ideally, the only way liquid can be withdrawn from such cups other than by removing their covers and pouring out the contents is by a toddler sucking on the drinking spout of a cup. The prior art products on the market perform with varying degrees of success, and many are relatively expensive to manufacture. Examples of the prior art are shown in U.S. Pat. Nos. 2,876,772; 3,967,748; 4,135,513; 4,836,404; 4,946,062; 5,050,758; 5,079,013; 5,186,347; 5,339,982; 5,542,670; 5,607,073; 5,706,973; 5,890,621; GB2,169,210; GB2,266,045; EP0634,922.

SUMMARY OF THE INVENTION

The training cup in accordance with one aspect of this invention has a detachable lid with a drinking spout extending upwardly therefrom. A valve assembly including a housing is mounted on the inner side of the lid in communication with the inlet end of the spout so that liquid to be drawn through the spout must flow through the housing. In accordance with another aspect of this invention the valve assembly includes a diaphragm valve in and supported by the housing and biased to a closed position. The diaphragm valve remains closed unless the pressure on the outlet side of the diaphragm is less than the pressure on the inlet side thereof. In accordance with another aspect of the invention, the diaphragm may be inexpensively made of a thin silicon wafer approximately 0.040 inch in thickness that may be extruded in sheet form and simply stamped from the sheet in the size and shape desired. In accordance with yet another aspect of the invention a strap is connected to the valve housing and is separately attached to the lid so that the housing can be separated from the spout while the strap remains attached to the lid so that it will not be lost or misplaced.

In accordance with yet another aspect of the invention, the vent hole in the lid is closed by a hydrophobic membrane that allows air to enter the cup through the hole but prevents liquid from flowing out of the cup through the hole.

The invention will be better understood and appreciated from the following detailed description read in conjunction with the accompanying drawings.

DETAILED DESCRIPTION

Figure 1:
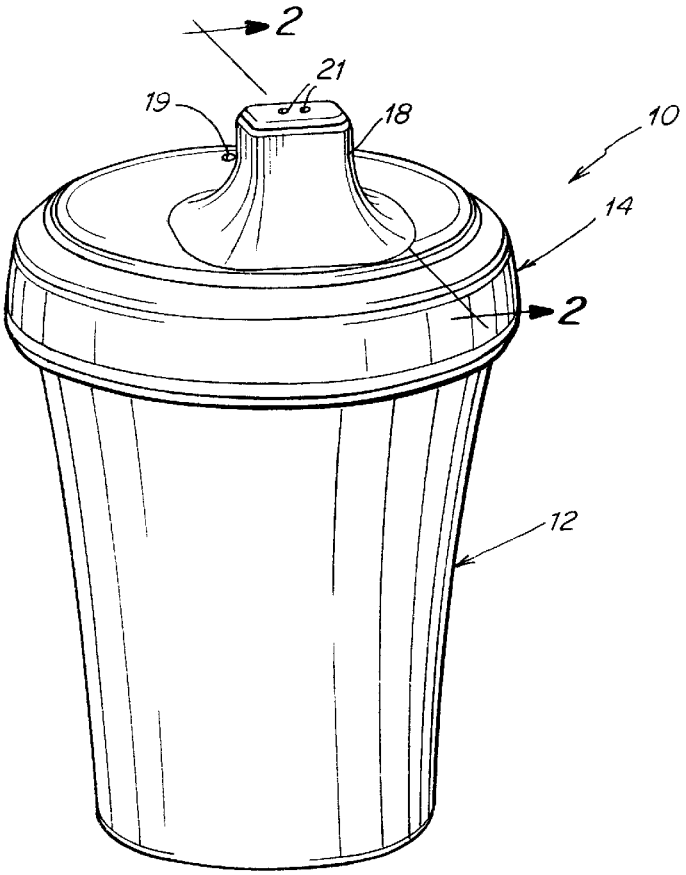
FIG. 1 is a perspective view of a training cup embodying this invention.

In FIG. 1 a training cup 10 is shown, that is typical of the type of cup in which the present invention may be incorporated. The cup includes a base container 12 and lid or cover 14 that may be threaded together as suggested at 16 or have some other connecting means such as a bayonet joint, friction fit etc. The lid 14 has a spout 18 molded as an integral part of the lid and formed of a rigid plastic material such as polypropylene. The spout has a passage 20 therethrough that allows liquid to be drawn from the container 12 into the mouth of the toddler drinking from the cup.

Figure 7:
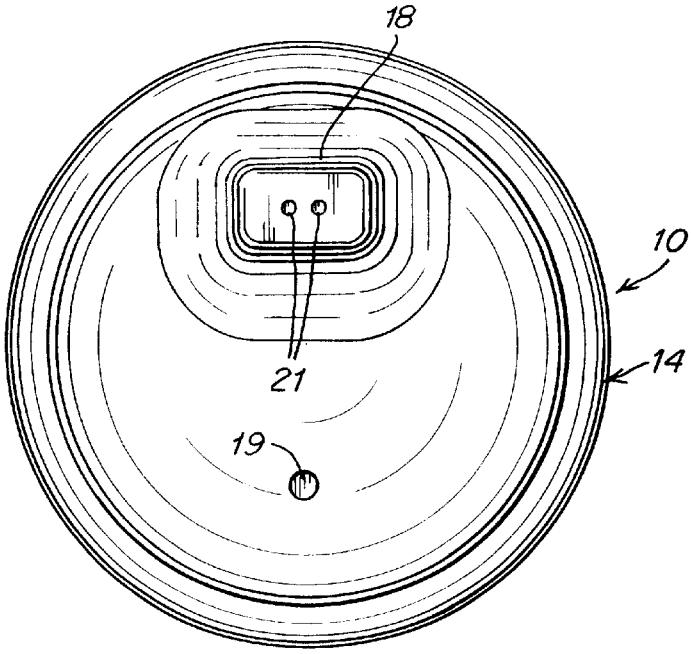
FIG. 7 is a top plan view of the lid.

The lid also has a vent opening 19 spaced from the spout 18, through which air can flow into the cup to equalize pressures inside and outside the cup 10 so that liquid can be readily drawn from it through the spout. A pair of openings 21 in the top of the spout (see FIGS. 1 and 7) permit liquid to flow from the passage 20 into the mouth of the child drinking from the cup.

Figure 2:
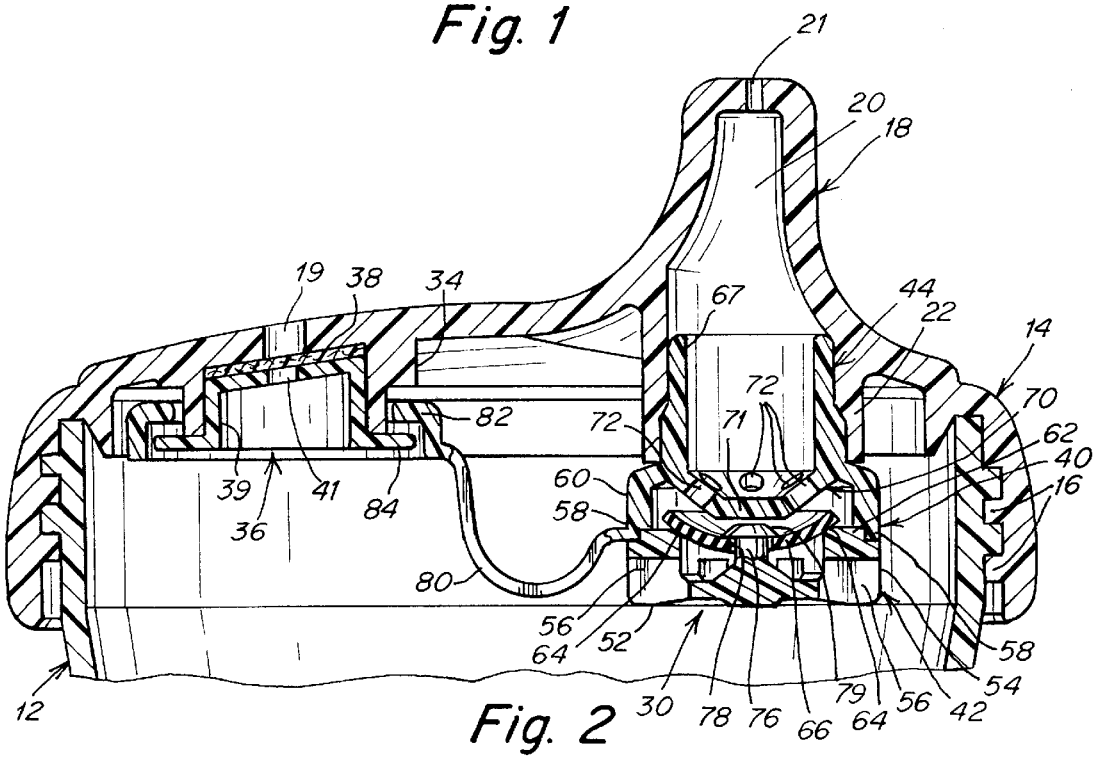
FIG. 2 is a fragmentary cross-sectional view thereof taken along section line 2—2 of FIG. 1 with one preferred embodiment of a spill proof valve of this invention shown in the closed position.

As shown in FIG. 2, the passage 20 on the underside of the lid terminates in a collar 22 that receives the valve assembly 30 that prevents liquid in the container from flowing out of it through the passage and openings 21 unless a child is sucking on the spout 18 so as to produce a low pressure region on the outlet side of the passage downstream of the assembly. (The valve assembly 30 is described in detail below.) A second collar 34 is formed on the inner surface of the lid 14 as an integral part thereof and surrounds the vent opening 19. Collar 34 receives a flow control assembly 36 that includes a support 39 and a flow control membrane 38. As shown the support 39 telescopically registers with the collar and may be ultrasonically welded in place although other means may be employed to retain it in the collar, such as a friction fit, threads, bayonet connector, etc. The assembly 36 includes the flow controller 38 for preventing liquid in the cup from flowing out of it through the vent hole 19. The flow controller 38 in the preferred embodiment of this invention is a hydrophobic membrane attached to the lid immediately below the vent hole 19 to cover it. As is well known in the art, the hydrophobic membrane allows air to pass through it but prevents liquid from flowing therethrough. As a result, there is constant air communication between the exterior and interior of the cup 10 so as to prevent a low pressure region (partial vacuum) from forming in it that would retard or prevent liquid from being drawn from the cup through the spout 18. However, the membrane 38 will prevent liquid in the cup from spilling out through the vent opening 19 should the cup be turned over or otherwise assume a position that causes the liquid to flow toward the opening. It should be noted in FIGS. 2 and 3 that a port 41 is provided at the top of the frame 39 so that the frame will not interfere with the free flow of air between the interior and exterior of the cup. In the preferred embodiment the support 39 is ultrasonically welded in place so that at all times it remains attached to the cover and retains the membrane 38 in place. While the hydrophobic membrane is the preferred means for preventing liquid in the cup from flowing out the vent opening, other devices may be used such as valves, dams, etc.

Figure 3:
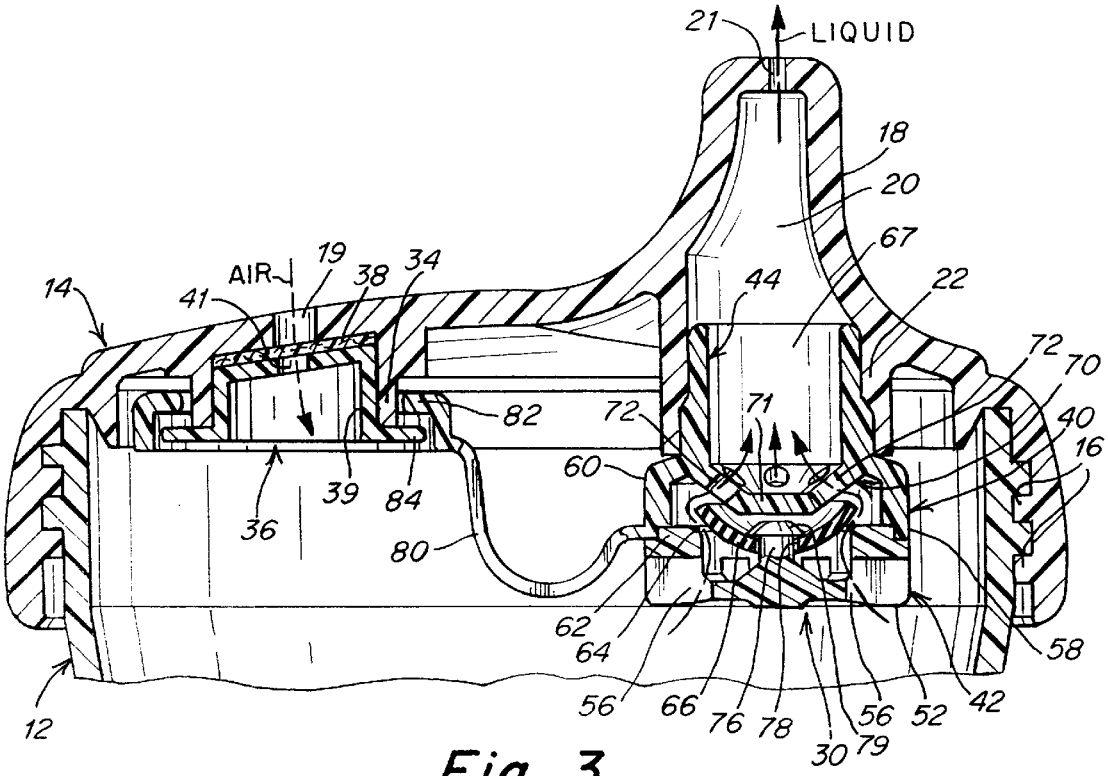
FIG. 3 is a fragmentary cross-sectional view similar to FIG. 2 but with the spill proof valve in the open position.
Figure 4:
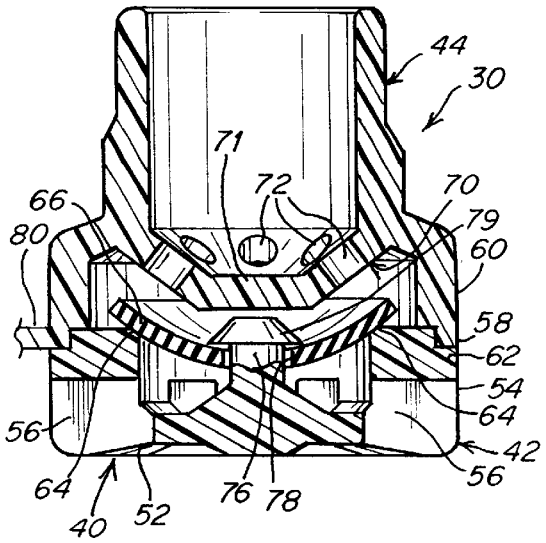
FIG. 4 is an enlarged fragmentary cross-sectional view of the preferred embodiment of the spill proof valve of this invention also shown in FIGS. 2 and 3.

In FIGS. 2–4 the valve assembly 30 for controlling the flow of liquid through the spout 18 is shown in detail. The valve assembly includes a housing 40 having an inlet section 42 and an outlet section 44. Outlet section 44 telescopically engages the collar 22 formed as an integral part of the cup lid 14 and in communication with the drinking spout 18. Both sections 42 and 44 of the housing 40 may be molded of a rigid plastic such as polypropylene or similar material. Inlet section 42 has an end wall 52 and skirt 54 in which are formed a number of generally radially oriented passages 56 (see FIG. 5) that allow liquid in the cup to enter the interior of the housing 40. The passages 56 need not be radially oriented but must permit the flow of liquid into the housing. The edge 62 of the skirt 54 may be ultrasonically welded or otherwise secured to the lower end 58 of the cylindrical wall 60 of the outlet section 44. The inner edge 64 of the skirt 54 serves as a valve seat for the diaphragm 66 as is described more fully below. Typically the diaphragm is made of silicon and is approximately 0.60" in diameter and 0.040" in thickness. While silicon is a suitable material when made in the dimensions suggested, other materials and other dimensions may be used so long as the diaphragm responds to the pressure differential across it applied by a toddler sucking on the spout so as to separate from the diaphragm seat 64 in the valve, as described in more detail below and shown in FIG. 3.

The cylindrical wall 60 of the outlet section 44 of the housing 40 has a reduced outer diameter at its discharge end 67 so as to telescope with and frictionally engage the inside of the collar 22. Although a friction fit is described other types of connections may be employed such as threads, undercuts, bayonet joints etc. The diameter of the wall 60 is enlarged at the inlet end 58. Tabs 61 (see FIG. 5) preferably are provided on the housing so as to facilitate its withdrawal from the collar for washing and/or replacement.

A bridge 70 extends across the outlet section 44 of housing 40 adjacent its inlet section 42. The bridge 70 illustrated is frustoconical with its apex 71 disposed at the inlet end 58 of cylindrical wall 60. A plurality of passages 72 extend through the cone-shaped portion of the bridge. A post 76 integral with the end wall 52 at inlet section 42 extends upwardly from the center of the end wall 52 in the direction of the apex 71 of bridge 70. The post 76 extends through a hole 78 in the center of the diaphragm 66 and has a head 79 at its end to retain the diaphragm on the post. The diaphragm 66 is trapped between the head 79 and the valve seat 64 formed on the end 62 of the skirt 54.

As is evident in the drawing, the diaphragm 66 is bowed by virtue of the contact of its peripheral portion with the seat 64 at the upper end 62 of the cylindrical portion 54 of the end wall 52 of housing 40. In the position illustrated in FIGS. 2 and 4 the diaphragm 66 is under stress so that the periphery forms a seal with the seat 64 and closes the inlet end of the upper section 44, and no flow of liquid is permitted through the valve from the interior of the cup to and through the spout passage 20. The diaphragm 66 deflects to the position shown in FIG. 3 so as to unseat its periphery from the valve seat 64 when a slight difference in pressure is exerted across the diaphragm such as may be created by a child sucking on the drinking spout 18 of the cup. Therefore, a child may drink from the cup by drawing on the spout, but the moment the child ceases the sucking action, the valve will close (diaphragm 66 engages the seat 64) and thereby prohibit the flow of liquid from the cup through the spout even when the cup is inverted or tipped on its side.

Figure 5:
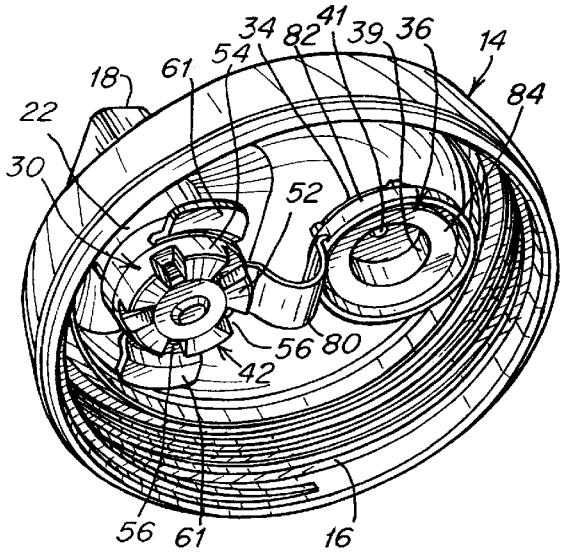
FIG. 5 is a bottom perspective view of the lid and valve assembly shown in FIGS. 2–4.

As illustrated in FIGS. 2, 3 and 5, the valve housing 40 carries a flexible strap 80 that has a ring 82 at its free end that surrounds the collar 34 about the vent opening 19 on the under side of the lid. In the embodiment shown the strap 80 is integrally formed with the outlet member 44 of the valve assembly 30, but the strap may be separately fabricated and subsequently attached to the assembly. Moreover, the strap may be attached to the lower section 42 rather than the member 44. The ring 82 in turn is held in place by the flange 84 of the support 39. The valve housing 40 may be separated from the lid 14 by withdrawing the outlet member 44 from the collar 22. This enables the valve assembly and spout to be washed thoroughly without totally detaching the assembly 30 from the lid or disassembling the valve housing 40. Therefore the valve assembly can not be lost or misplaced for it remains attached to the lid by the strap 80 and ring 82. Furthermore, the assembly 30 does not include any small, loose parts that may become detached and create a hazard to a child using the cup. The flow controller support 39 may be integrally formed with the strap 80 and valve assembly housing 40 to unitize the entire assembly if desired. With this arrangement, the ring 82 may be eliminated, and the strap 80 will remain attached to the lid 14 by virtue of the connection, preferably permanent, between the support 39 and collar 34.

Figure 6:
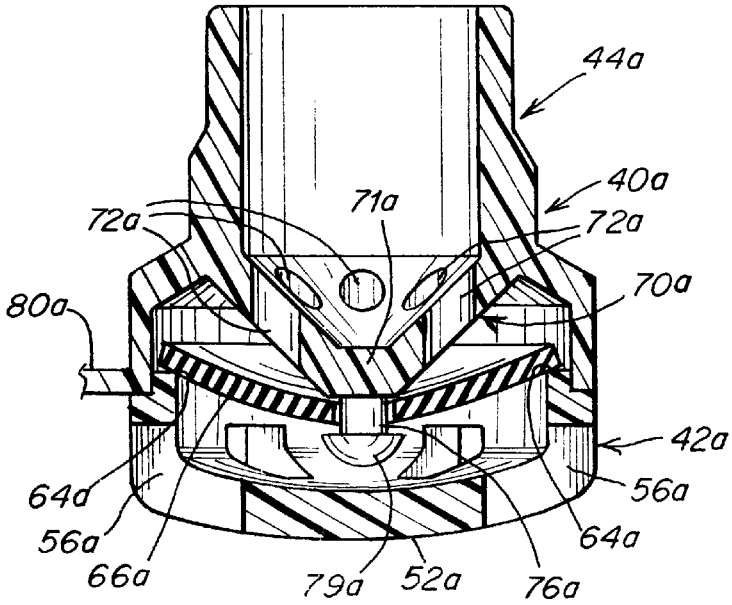
FIG. 6 is an enlarged cross-sectional view similar to FIG. 4 of a second preferred embodiment of the spill proof valve of this invention.

In FIG. 6, another preferred embodiment of the valve assembly for the spout is shown, quite similar to that of the preferred embodiment of FIGS. 2–4. The corresponding parts of the two embodiments are similarly numbered. Specifically, the housing 40*a* of this embodiment is composed of lower section 42*a* and upper section 44*a* connected together in the same manner described above in connection with the embodiment of FIGS. 2–4. The diaphragm 66*a*, however, is mounted on a post 76*a* carried on the apex 71*a* of the cone-shaped bridge 70*a* rather than on the bottom wall of the inlet section 42*a* as in FIGS. 2–4, and is retained on the post by the head 79*a*. The diaphragm 66*a* is biased to engage the valve seat 64*a* on the rim of the end wall 52*a*. The diaphragm 66*a* is stressed in its closed position so as to seal the inlet end of the upper section 44*a* of the housing. When a child sucks on the spout 18 to draw fluid from the cup, the diaphragm 66*a* deflects further so as to unseat the diaphragm periphery from the valve seat 64*a* and allow liquid to flow to the child's mouth. The moment the child stops sucking on the spout, the pressure differential across the diaphragm 66*a* will no longer exist and therefore the diaphragm will reseat on the valve seat 64*a* and again close the valve.

In both embodiments illustrated the bridge 70 (70*a*) creates a barrier in the valve housing down stream of the diaphragm 66 (66*a*) that precludes it from travelling to a child's mouth should the diaphragm break away from the post 76 (76*a*). This protection is further abetted by the proximity of the apex 71 (71*a*) to the head 79 (79*a*) of the post.

From the foregoing description it will be appreciated that liquid can flow out of the cup only if a pressure drop is created across the valve 66 (66*a*) so as to unseat it. Therefore, even when the cup is tilted or inverted no liquid will flow from it either through the spout 18 or the vent opening 19. In this fashion a spill proof cup is achieved. Moreover, the ability to detach the valve housing 44 (44*a*) from the spout while the entire valve assembly 30 remains attached to the lid is a substantial advantage of the construction, as parts will not become lost. Furthermore, there are no small parts in the valve assembly in the spout or the flow controller assembly at the vent opening that can create a hazard to a child.

Having described the various aspects of this invention in detail, those skilled in the art will appreciate that numerous modifications may be made of this invention without departing from its spirit. For example, while the valve assemblies 40 and 40*a* are described and shown as being mounted in the collar 22, the collar may be eliminated as the valve assemblies may be mounted directly in the passage 20 in the spout. Therefore, it is not intended that the breadth of the invention be limited to the specific embodiments illustrated and described. Rather, the breadth of the invention is to be determined by the appended claims and their equivalents.

What is claimed is:

1. A no spill training cup comprising a cup and a removable cover attached to the cup, a spout on the cover having a passage therethrough for drawing liquid from the cup, and a valve assembly disposed on the inside of the cover for preventing liquid from accidentally flowing from the cup out the spout, said assembly including a housing having an inlet opening for liquid to enter the housing from the interior of the cup and an outlet opening for liquid in the housing to flow into the spout, a valve seat in the housing and a diaphragm valve cooperating with the seat for preventing flow of liquid from the inlet opening to the outlet opening when the valve engages the seat, said valve being biased to a closed position engaging the seat but disengaging the seat to move to an opened position in response to a drop in pressure across the diaphragm caused by sucking action on the spout, a cone-shaped bridge located in the housing between the inlet and outlet openings and formed to include fluid flow passages therein, said diaphragm being supported at its center from one side only in the housing and positioned to lie between the valve seat and the bridge.

2. A no spill training cup as defined in claim 1 wherein said housing has an inlet section on one side of the diaphragm valve and an outlet section on the other side thereof and a support for the diaphragm valve being connected to one of the housing sections.

3. A no spill training cup as defined in claim 2 wherein the support for the diaphragm is connected to the inlet section of the housing.

4. A no spill training cup as defined in claim 2 wherein the support for the diaphragm is connected to the outlet section of the housing.

5. A no spill training cup comprising a cup and a cover detachably connected to the cup for holding liquid, said cover having a drinking spout extending therefrom through which liquid may be drawn from the cup and an air inlet opening for maintaining the air pressure in the cup at ambient pressure, and a valve assembly mounted on the inside of the cover for preventing accidental flow of liquid from the container through the spout, said valve assembly including a housing having an inlet opening for liquid to enter the housing from the interior of the cup and an outlet opening for liquid in the housing to flow into the spout, the housing being releasably coupled to the cover at the spout, a valve positioned to lie in the housing between the inlet and outlet openings, a valve seat in the housing and a diaphragm valve cooperating with the seat for preventing flow of liquid from the inlet opening to the outlet opening when the valve is seated on the seat, said valve being biased to a position to engage the seat but disengaging the seat in response to a drop in pressure across the diaphragm caused by sucking action on the spout, flow control means operatively connected to the cover at the air inlet opening for preventing liquid in the cup from flowing out of the cup through said air inlet opening, and tether means for tethering the housing to the cover to allow the housing to be separated from the cover at the spout to facilitate washing of the housing and the valve in the housing without separating the flow control means from the cover so that a washing fluid can flow through the inlet and outlet openings formed in the housing while the housing is tethered to the cover.

6. A no spill training cup as described in claim 5 wherein said flow control means is a membrane and support, said support, tether means, and valve housing being connected together as a unitary structure.

7. A no spill training cup as described in claim 6 wherein a first collar is formed on the inside of the cover and in communication with the spout and a second collar is connected to the cover in communication with the air inlet opening, said housing being releasably connected to the first collar and the support being connected to the second collar.

8. A no spill training cup as defined in claim 5 wherein a support for the diaphragm valve is connected to the inlet section of the housing.

9. A no spill training cup as defined in claim 5 wherein a support for the diaphragm valve is connected to the outlet section of the housing.

10. A no spill training cup as defined in claim 1 wherein the housing is detachably connected to the spout.

11. A no spill training cup as defined in claim 10 wherein a flexible anchor strap is attached to the housing and to the lid for retaining the housing to the lid when the housing is detached from the spout.

12. A no spill training cup as defined in claim 10 wherein means are provided in the lid for attaching the strap thereto.

13. A no spill training cup as defined in claim 5 wherein the diaphragm is supported at its center from one side only by the housing.

14. A no spill training cup as defined in claim 13 wherein the valve seat is on the inlet section of the housing.

15. A no spill training cup as defined in claim 1 wherein a vent opening is provided in the lid for equalizing pressure eon the inside and outside of the cup.

16. A no spill training cup as defined in claim 15 wherein the vent opening is covered by a hydrophobic membrane for preventing liquid in the cup from flowing out through the vent opening.

17. A no spill training cup as defined in claim 15 wherein means are provided on the lid for preventing liquid from flowing out of the cup through the opening while permitting air to flow therethrough.

18. A no spill training cup as defined in claim 5 wherein means are provided in the housing for preventing the diaphragm from passing out of the housing to the spout.

19. A no spill training cup as defined in claim 18 wherein the means is a bridge spanning the housing on the spout side of the diaphragm.

20. A no spill training cup as defined in claim 19 wherein the diaphragm is supported by a post connected to the inlet opening side of the housing.

21. A no spill training cup as defined in claim 19 wherein the diaphragm is supported by a post attached to the bridge.

22. A child's training cup comprising a container having an open top and a removable lid for closing the top of the container, a spout attached to the lid having a passage therethrough for enabling a child to draw liquid from the container, a valve assembly releasably attached to the lid for controlling the flow of liquid in the container out the spout, said valve assembly including a valve and a valve seat for the valve and a post for supporting the valve to engage the seat for preventing the flow of liquid from the container out the spout when the valve engages the seat, said valve engaging the seat when the pressure in the container is equal to ambient pressure in the spout and moving from the seat for allowing flow of liquid from the container out the spout when a child drawing on the spout lowers the pressure on the outlet side of the valve below the pressure in the container, and a flexible strap coupled to the valve assembly and to the lid to allow separation of the valve assembly from the lid to facilitate washing of the valve assembly.

23. A child's training cup as described in claim 22 wherein the assembly includes a housing having an inlet end on the inlet side of the valve and an outlet end on the outlet side of the valve, said post being connected to one end only of the housing.

24. A child's training cup as described in claim 23 wherein the post is connected to the inlet end of the housing.

25. A child's training cup as described in claim 23 wherein the post is connected to the outlet end of the housing.

26. A child's training cup as described in claim 22 wherein the valve is a diaphragm and the periphery of the diaphragm is biased to engage the seat.

27. A child's training cup as described in claim 23 wherein a collar is attached to the bottom of the lid and aligned with the passage, and the housing is mounted on the collar.

28. A child's training cup as described in claim 27 wherein the housing is detachable from the collar, and means permanently attaches the housing to the lid.

29. A no spill training cup assembly comprising a cup, a removable lid attached to the cup, the lid being formed to include a first collar defining a fluid discharge passageway and a second collar defining an air vent passageway, a housing inlet section formed to include a fluid inlet passageway, a monolithic member including a removable housing outlet section attached to the first collar to conduct fluid into the fluid discharge passageway, a mount coupled to the second collar, and a flexible strap arranged to tether the removable housing outlet section to the mount following separation of the removable housing outlet section from the first collar, the housing inlet and outlet sections cooperating to define an interior region located to conduct fluid admitted through the fluid inlet passageway to the fluid discharge passageway, and a valve arranged in the interior region defined by the housing inlet and outlet sections to regulate fluid flow from the fluid inlet passageway to the fluid discharge passageway.

30. The cup assembly of claim 29, wherein the mount includes a ring arranged to surround the second collar and coupled to the flexible strap and further comprising a flow control assembly coupled to the second collar to retain the ring in an anchored position on the lid.

31. The cup assembly of claim 30, wherein the flow control assembly includes a support configured to extend into the second collar and a flow control membrane trapped between the lid and the support.

32. The cup assembly of claim 31, wherein the support includes a tubular portion having an upper end and a lower end, a plate coupled to the upper end to engage the flow control membrane and formed to include an air flow aperture arranged to conduct air passing through the air vent passageway and flow control membrane into the cup.

* * * * *